US005589920A

United States Patent [19]

Kubo et al.

[11] Patent Number: 5,589,920

[45] Date of Patent: Dec. 31, 1996

[54] IMAGE FORMING APPARATUS IN WHICH PLURAL TRANSFER MEDIA ARE CARRIED CONCURRENTLY

[75] Inventors: Takahiro Kubo, Tokyo; Masashi Suda, Iruma; Yoshihiro Murasawa, Yokohama; Takashi Hasegawa, Ageo; Satoshi Tamura, Yokohama; Hisashi Fukushima, Kawasaki; Takeshi Menjo, Tokyo, all of Japan

[73] Assignee: Canon Kabushiki Kaisha, Tokyo, Japan

[21] Appl. No.: 497,340

[22] Filed: Jun. 30, 1995

Related U.S. Application Data

[63] Continuation of Ser. No. 281,627, Jul. 28, 1994, abandoned.

[30] Foreign Application Priority Data

| | | | |
|---|---|---|---|
| Jul. 30, 1993 | [JP] | Japan | 5-208314 |
| Aug. 3, 1993 | [JP] | Japan | 5-212262 |
| Dec. 24, 1993 | [JP] | Japan | 5-347983 |

[51] Int. Cl.[6] ..... G03G 15/14

[52] U.S. Cl. ..... 399/145; 399/298

[58] Field of Search ..... 355/204, 208, 355/271, 272, 273, 284, 319, 326 R, 327

[56] References Cited

U.S. PATENT DOCUMENTS

| | | | |
|---|---|---|---|
| 4,712,906 | 12/1987 | Bothner et al. | 355/271 |
| 4,899,196 | 2/1990 | Mahoney | 355/271 |
| 5,006,900 | 4/1991 | Baughman et al. | 355/271 |
| 5,040,029 | 8/1991 | Rdenberg et al. | 355/271 |
| 5,148,224 | 9/1992 | Yamada et al. | 355/271 |
| 5,155,535 | 10/1992 | Bermel et al. | 355/326 R |
| 5,243,393 | 9/1993 | Menjo | 355/284 |
| 5,298,953 | 3/1994 | Lindblad et al. | 355/271 |

*Primary Examiner*—Sandra L. Brase

*Attorney, Agent, or Firm*—Fitzpatrick, Cella, Harper & Scinto

[57] ABSTRACT

An image forming apparatus includes an image carrier for carrying an image, and a transfer medium bearing member for bearing and conveying a transfer medium to a transfer unit of said image carrier. The transfer medium bearing member is able to bear multiple transfer media concurrently. The apparatus includes transfer device for transferring the image of the image carrier onto the transfer medium borne on the transfer medium bearing member in the transfer unit, and a plurality of transfer media capable of being borne on the transfer medium bearing member concurrently, wherein in consecutively transferring the image onto the transfer media of the number not divisible by the maximum sheet bearing number by which said transfer medium bearing member is capable of bearing the transfer media concurrently. The number of transfer media that the transfer medium bearing member concurrently bears at the n-th time where n is a natural number equal to or greater than two, is not less than the number of transfer media that it bears concurrently at the n-1-th time. In transferring the image consecutively as above, the number of sheets that the transfer medium bearing member concurrently bears at the final time is greater than the number of transfer media that the transfer medium bearing member concurrently bears at the first time.

37 Claims, 12 Drawing Sheets

IMAGE FORMING APPARATUS IN WHICH PLURAL TRANSFER MEDIA ARE CARRIED CONCURRENTLY

This application is a continuation of application Ser. No. 08/281,627, filed Jul. 28, 1994, now abandoned.

BACKGROUND OF THE INVENTION

1. Field of the Invention

The present invention relates to an image forming apparatus such as a copying machine or a printer, and more particularly to an image forming apparatus which transfers an image formed on an image carrier to a transfer medium borne by a transfer medium bearing member.

2. Related Background Art

Conventionally, a variety of full-color image forming apparatuses have been proposed and put to practical use which comprise a photosensitive drum as an image carrier and a transfer drum as a transfer medium bearing member for bearing the transfer medium such as a paper.

FIG. 10 shows a typical example of such a full-color image forming apparatus. This full-color image forming apparatus has a photosensitive drum 1 supported for free rotation in a direction of the arrow R, around the periphery of which a corona electrifier 2, an optical system 3, a developing device 5, a transfer device 6, and a cleaning unit 7 are disposed along a rotational direction thereof. Also, a transfer cleaning device 9 is disposed obliquely downward of the transfer device 6. The optical system 3, which is comprised of a scanning portion for development and a color separation filter, is an exposure device for exposing a color separated light image E or a light image E corresponding thereto to the photosensitive drum 1, for example, a laser beam exposure device as shown.

The light image E is directed for each separated color onto the photosensitive drum 1 which is uniformly electrified by the electrifier 2 to form an electrostatic latent image. The developing device 5 is a rotational developing device, having four developing units, i.e., a black developing unit 5BK, a cyan developing unit 5C, a magenta developing unit 5M, and a yellow developing unit 5Y, arranged around a central axis 5*a*, in which the electrostatic latent image on the photosensitive drum 1 is developed by rotating a predetermined developing unit to a developing position opposed to the photosensitive drum 1. This development is done by attaching the toner to the electrostatic latent image on the photosensitive drum 1 with a resin as the base substance to visualize the image (toner image).

Further, a toner image on the photosensitive drum 1 is transferred onto a transfer medium supplied to a position opposed to the photosensitive drum by means of the transfer device 6, the transfer medium being supplied from a transfer medium cassette 101 via a conveyance system along a paper path as indicated by the dotted line in the same figure. The transfer device 6 has a transfer drum 6*a*, a transfer corona electrifier 6*b*, an adsorption corona electrifier 6*c* for the electrostatic adsorption of the transfer medium, an adsorption roller 6*d* opposed thereto, an inner corona electrifier 6*e*, and an outer corona electrifier 6*f*, a transfer medium bearing sheet 6*g* composed of dielectric being extended cylindrically and integrally therewith over an opening region around the peripheral surface of the transfer drum 6*a* supported around its axis to be driven for rotation in a direction of the arrow R2. Along with the rotation of the transfer drum 6*a*, the toner image on the photosensitive drum is transferred successively by the transfer electrifier 6*b* onto the transfer medium borne on the transfer medium bearing sheet 6*g*. Onto the transfer medium adsorbed to and conveyed by the transfer medium bearing sheet 6*g* are transferred a desired number of color images to form a full-color image.

In this manner, if the transfer for the desired number of color images has been terminated, the transfer medium is separated from the transfer drum 6*a* by separation means 11, and the toner image is fused and fixed by a heat roller fixing unit 12, in which the fixing is performed at so high temperatures that the toner can sufficiently melt to cause the toner of two to four colors to be mixed in the fixing device for the color image forming apparatus. To this end, when the transfer medium passes through the nip portion between a heat roller 12*a* and a pressure roller 12*b*, with the front face side onto which the toner is transferred upside, the transfer medium is likely to wrap around the heat roller 12*a*, resulting in a problem that the toner on the transfer medium is offset to the heat roller 12*a*. Thus, to prevent the above-mentioned problem, a quantity of silicone oil as the release agent is applied to the heat roller 12*a*. After the toner image is transferred, the photosensitive drum 1 and the transfer medium bearing sheet 6*g* lend themselves to the image forming process again after the residual toner left on the surface is cleaned by the cleaning unit 7 and the transfer cleaning device 9 which are cleaning means, respectively.

In the above image forming process, the image is formed on the transfer medium having any of various lengths (extending along the conveyance direction, the same hereinafter). Where the length of the transfer medium is not more than one-half of the peripheral length of the transfer drum 6*a*, one method has been adopted in which more than one transfer medium is borne on the transfer medium bearing sheet 6*g* concurrently to form an image, thereby speeding up the throughput in effecting the continuous image formation. For example, where the peripheral length of the transfer drum is long enough to bear two transfer media concurrently, and if the image formation for five sheets is consecutively performed, two sheets—two sheets—one sheet are borne in succession, that is, two sheets are borne at the first and second time, respectively, and one sheet is borne at the third time, to complete the image formation. Since the rotational rate of the transfer drum 6*a* is substantially constant in making the image formation, the through-put speed is substantially proportional to the rotation number of the transfer drum necessary to form the image on all the transfer media. As above described, when the image formation is performed on five transfer media by bearing two sheets each time, the image formation can be completed in roughly three-fifth the time required for making the image formation by bearing one sheet on the transfer drum 6*a* each time.

By the way, as shown in FIG. 6, silicone oil Si applied to the heat roller 12*a* may adhere to the transfer medium P having the toner image fixed thereon in passing through the fixing unit 12. This silicone oil Si is absorbed into the transfer medium P on the side of the surface where no toner image T is formed, but is not absorbed on the opposite face side of the transfer medium P which the toner image T covers like a resin, and resides on the surface of the toner T. Accordingly, when the transfer medium P having the image formed on the first face is caused to form the image on the second face, silicone oil Si adhering to the transfer medium P may be transferred back to the object positioned adjacently on the conveyance passageway, possibly causing a problem as will be described later.

The oil present on the first face of the transfer medium having the image formed on the first face is first transitted onto the transfer medium bearing sheet 6*g* of the transfer drum 6*a*. Further, the oil on the transfer medium bearing sheet 6*g* is transitted onto the surface of the photosensitive drum 1 when the photosensitive drum 1 and the transfer drum 6*a* are contacted in the transfer unit. By this transition of the oil onto the photosensitive drum 1, the toner deposit may occur if the development is conducted with poor cleaning, significantly reducing the life of the photosensitive drum 1.

At present, various apparatuses having a cleaning device for removing such oil on the transfer medium bearing sheet 6*g* have been proposed in which the cleaning timing takes place after the transfer of the final color. Accordingly, particularly when the image is formed on both faces of the transfer medium with a plurality of transfer media borne on the transfer drum 6*a* concurrently, the oil remaining on the transfer medium bearing sheet 6*g* of the side where no transfer medium is borne may be transitted onto the photosensitive drum 1 upon forming the image on the final one sheet, for example, if the image is formed consecutively on the odd number of sheets, with two sheets borne concurrently. Of course, it is necessary that this oil on the transfer medium bearing sheet 6*g* be removed by an oil removal cleaner, but this is unpreferable because the color aberration may occur upon a shock given to the transfer drum 6*a* during the course of the image formation.

Therefore, in particular, if the image formation on both faces is performed consecutively for a plurality of sheets which are borne on the transfer drum 6*a* concurrently, the oil remains on the surface of the photosensitive drum 1, and thereafter, if the image formation is normally performed one sheet each time, the toner may be attached to the area originally white, owing to the adhesion of the oil, appearing as the fog, while in the area which is originally the solid part, the toner may not be fully transferred from the photosensitive drum i onto the transfer medium, also owing to the adhesion of the oil, resulting in a problem of producing a vague image.

To prevent this, it was previously practiced to cut off the transfer current on the course of copying one sheet, or release the pressure of the transfer 1 medium bearing sheet against the image carrier, but which exhibited less sufficient effects and often caused image degradation due to the shock.

SUMMARY OF THE INVENTION

Accordingly, an object of the present invention is to provide an image forming apparatus which can form a high quality image by preventing the contamination of an image carrier.

Further, it is another object of the present invention to prevent the transition of a release agent present on the first face of a transfer medium onto the image carrier.

Further, it is another object of the present invention to prevent the transition of contamination of a transfer medium bearing member onto the image carrier in transferring an image on the image carrier onto a plurality of transfer media.

The further objects and features of the present invention will be more apparent by reading the following description with reference to the accompanying drawings.

DETAILED DESCRIPTION OF THE PREFERRED EMBODIMENTS

An image forming apparatus according to the present invention will be now described in detail in connection with the drawings.

<EXAMPLE 1>

Figure 1:
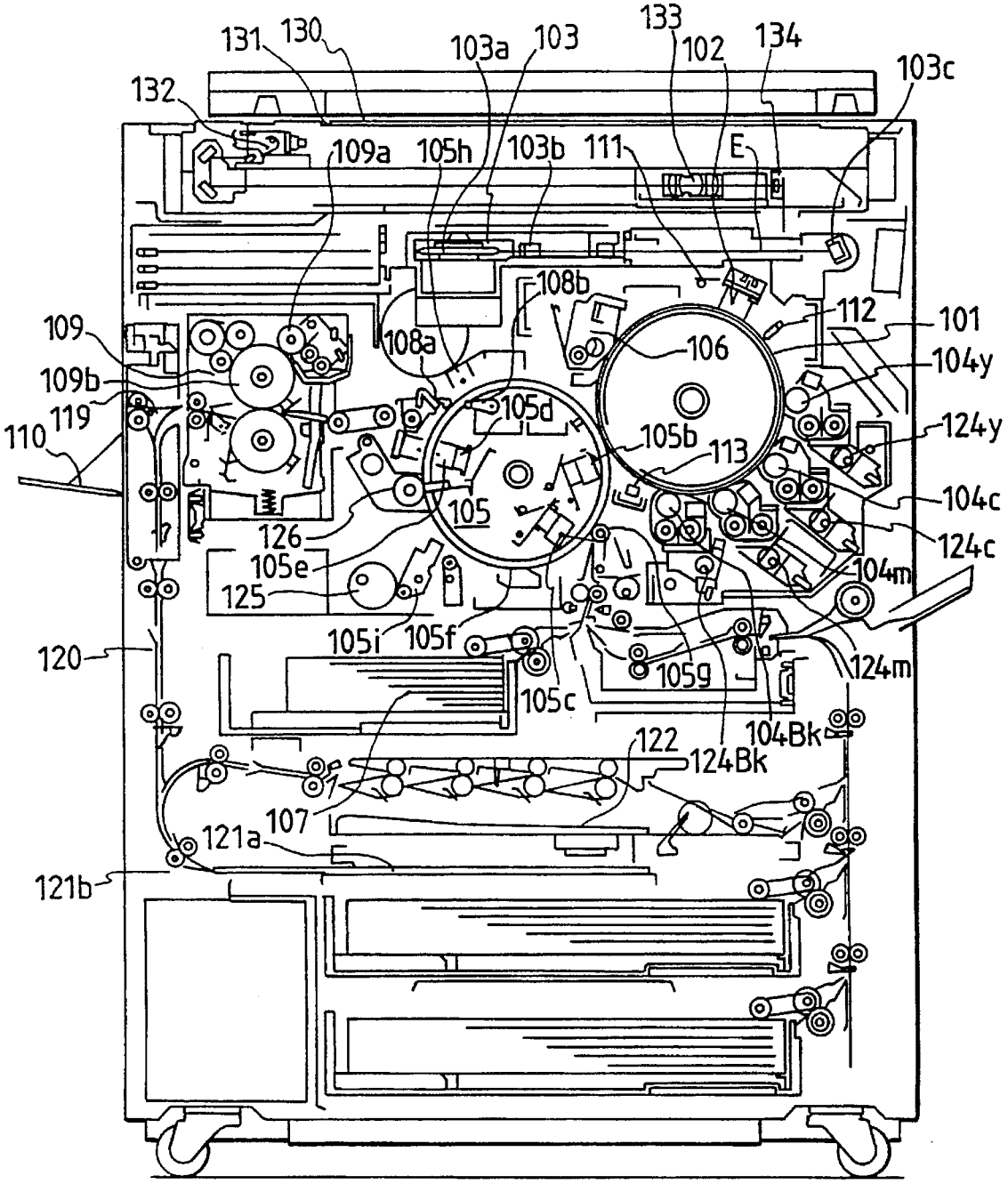
FIG. 1 is a longitudinal cross-sectional view showing a schematic construction of a color image forming apparatus in an example 1.

Referring now to FIG. 1, a color image forming apparatus will be described herein, to which the present invention can be favorably embodied. The color image forming apparatus has a digital color image reader unit on its upper portion, and a digital color image printer unit on its lower portion. In the reader unit, an original 130 is laid on an original board glass 131, and an optical image reflected from the original 130 which is obtained by exposure scanning with an exposure lamp 132 is condensed via a lens 133 into a full-color sensor 134 to obtain a color separated image signal. This color separated image signal is amplified by an amplification circuit, not shown, then processed through a video processing unit, and sent to the printer unit.

In the printer unit, a photosensitive drum 101 which is an image carrier is borne for free rotation in a direction of the arrow in the figure. Around the periphery of this photosensitive drum 101, there are disposed a pre-exposure lamp 111 for initializing the surface of the photosensitive drum 101, a corona electrifier 102 for uniformly electrifying the surface of the photosensitive drum 101, a laser exposure optical system 103 for forming an electrostatic latent image on the photosensitive drum 101 in accordance with image information, a potential sensor 112 for detecting the potential on the surface of the photosensitive drum 101, four developing units 104*c*, 104*m*, 104*y*, 104Bk for accommodating developers (toners) of different colors serving to develop the electrostatic latent image formed on the photosensitive drum 101 to a visual image, light sensing means 113 for sensing the amount of toner on the photosensitive drum 101, a transfer device 105 including a transfer drum 105*a* as a transfer medium bearing member, and a cleaning unit 106 for removing the developer remaining on the photosensitive drum 1.

The exposure optical system 103 is comprised of a polygon mirror 103*a*, a lens 103*b*, and a mirror 103*c* in this example, a laser beam E from a laser output unit, which is modulated by a color image signal for each color and color separated from the reader unit, is reflected by the polygon mirror 103*a*, passed through the lens 103*b* and the mirror 103*a*, and projected onto the surface of the photosensitive drum 101, thereby forming an electrostatic latent image corresponding to a color image signal for each color. In making the image formation in the printer unit, the photosensitive drum 101 is rotated in a direction of the arrow in the figure to first cause the pre-exposure lamp 111 to eliminate static on the surface of the photosensitive drum 101 and to initialize it, and then cause the electrifier 102 to uniformly electrify the surface of the photosensitive drum 101, whereafter an optical image E corresponding to an image signal for each color which is color separated by image exposure means 3 is directed in succession onto the surface of the photosensitive drum 101 to form an electrostatic latent image in a predetermined color sequence.

Then, each latent image on the photosensitive drum 101 is developed by operating a predetermined developing unit to form a toner image with a resin as the base substance in succession on the photosensitive drum 101. Each developing unit 104*c*, 104*m*, 104*y* and 104Bk is configured to perform the development by selectively accessing to the photosensitive drum 101 in accordance with each separated color under the action of each of eccentric cams 124*c*, 124*m*, 124*y* and 124Bk.

Further, the toner image on the photosensitive drum 101 is transferred onto a recording medium supplied to a position opposed to the photosensitive drum 101 via the conveyance system and the transfer device 105 by the transfer medium cassette 107. The transfer device 105 has a transfer drum 105*a*, a transfer electrifier 105 as transfer means for transferring the toner image on the photosensitive drum 1 onto the transfer medium in the transfer unit, an adsorption roller 105*g* opposed to an adsorption corona electrifier 105*c* for adsorbing the transfer medium to the transfer drum 105*a*, an inner electrifier 105*d* and an outer electrifier 105*e* in this example, a transfer medium bearing sheet 105*f* composed of dielectric which is a transfer medium bearing member being extended cylindrically and integrally therewith over an opening area on the peripheral surface of the transfer drum 105*a* supported around its axis to be driven for rotation. This transfer medium bearing sheet 105*f* used herein is a dielectric sheet such as a polycarbonate film.

The toner image on the photosensitive drum is transferred onto the transfer medium borne on the transfer medium bearing sheet 105*f* by the transfer electrifier 105*b*, while rotating the transfer device made like a drum, that is, the transfer drum 105*a*. Note that two transfer media can be borne on the transfer medium bearing sheet 105*f* in this example. In this manner, the transfer medium adsorbed to and conveyed by the transfer medium bearing sheet 105*f* has color images of desired number transferred to form a full-color image.

In the case of forming the full-color image, the transfer medium is separated from the transfer drum 105*a* under the action of a separation claw 108*a*, a separation forcing roller 108*b* and a separation electrifier 105*h* and exhausted via a heat roller fixing unit 109 into a tray 110, if the transfer for the toner image of four colors is ended in this manner. The heat roller 109*b* has a release agent applied thereon by an application roller unit 109*a* for applying the release agent such as a silicone oil to prevent the transfer medium from wrapping around the heat roller 109*b*.

On the other hand, after transferring, the photosensitive drum 101 lends itself to the image forming process again after the residual toner left on the surface is cleaned by the cleaning unit 106.

When the image is formed on both faces of the transfer medium, a conveyance pass switching guide 119 is driven immediately after the transfer medium is exhausted out of the fixing unit 109 to allow the transfer medium to be led along a conveyance longitudinal path 120 to a reversal path 121*a*, and then, the transfer medium delivered thereto is turned around so that the trailing end becomes the top end by the reversal rotation of a reversal rotation roller 121*b*, caused to exit in an opposite direction to that when delivered, and then be received within an intermediate tray 122. Thereafter, this transfer medium is conveyed again from the intermediate tray 122 to the transfer device 105 to form an image on the opposite surface through the above-described image forming process.

In this example, the gap between the recording medium bearing sheet 105*f* and the photosensitive drum 101 is configured to be arbitrarily set by operating an eccentric cam 125 at a desired timing to activate a cam follower 105*i* integral with the transfer drum 105*a*. At the stand-by (waiting) or power-off, for example, the transfer drum 5*a* is spaced away from the photosensitive drum 1. Or the pressure of the transfer electrifier 105*b* onto the transfer medium bearing sheet 105*f* is released.

Further, a transfer cleaning device 126 as cleaning means for removing unnecessary toner or oil is provided on the recording medium bearing sheet 105*f* of the transfer drum 105*a*.

Figure 2:
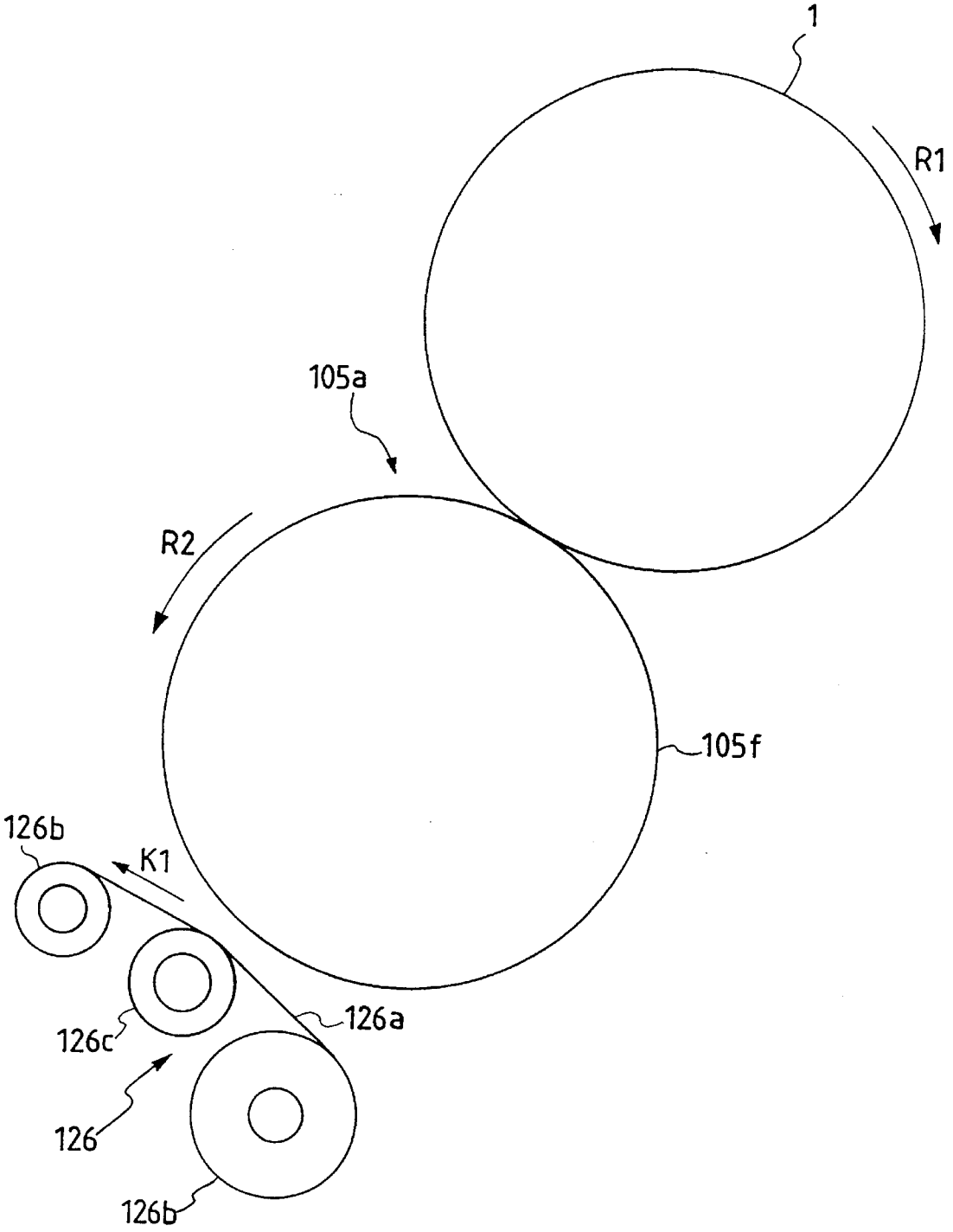
FIG. 2 is a longitudinal cross-sectional view showing a construction of a transfer cleaning device in the example 1.

Herein, the transfer cleaning device 126 which is also used to remove the oil is composed of a transfer cleaning member of the web type as shown in FIG. 2. A web is formed by wrapping a non-woven fabric 126*a* like a cloth around one roller 126*b*, and this non-woven fabric 126*a* is wound by another roller 126*b* in a direction of the arrow K1. Then, the non-woven fabric 126*b* is forced from the back side by another roller 126*c* into contact with the surface of the transfer drum 105*a* at an adequate pressure. The toner and oil are cleaned away by rubbing on the transfer medium bearing sheet 105*f* of the transfer drum 105*a* by moving the non-woven fabric in the direction of the arrow K1 while the non-woven fabric is being contacted with the transfer drum 105*a* rotating in a direction of the arrow R2.

The properties of the material of the non-woven fabric used in this example are as follows:

—Fiber material: Synthetic non-woven fiber of nylon and polyester

—Fiber size: Average size is 4 μm, the percentage of 10 μm or less in the size distribution is 90%.

—Density of non-woven fabric: 0.17 g/cm$^3$

—Average interval between fibers: 2.5 μm

—Thickness of non-woven fabric: 500 μm

By using such a non-woven fabric 126*a*, the oil on the transfer medium bearing sheet 105*g* is almost completely removed. Note that as a result of examining the materials of the fiber constituting the non-woven fabric 126*a* including, in addition to those of this example, polypropylene, rayon, acrylic, nylon, polyester, vinilon and synthetic fibers thereof, there was no significant difference. The density of fiber for the non-woven fabric 126*a* may be from 0.05 to 0.80 g/cm$^3$, and preferably from 0.1 to 0.5 g/cm$^3$, in which range excellent oil removal capability was found.

Further, although those materials were used as the appropriately woven cloth, but not the non-woven fabric, the unevenness in wiping the oil might occur in the weaving (knitting) direction, so that the setting condition was unfavorably narrowed in the range for use as the oil cleaning member. In order to enhance the absorbance of the oil, the transfer cleaning member may be constituted of two layers: an oil removal layer and an oil absorbing layer. Further, the shape may be made not only like a web, but also like a roller, to the same effects of the present invention. Also, by shaping it like a roller, there is a merit that the device can be simplified as compared with the web type.

Figure 3A:
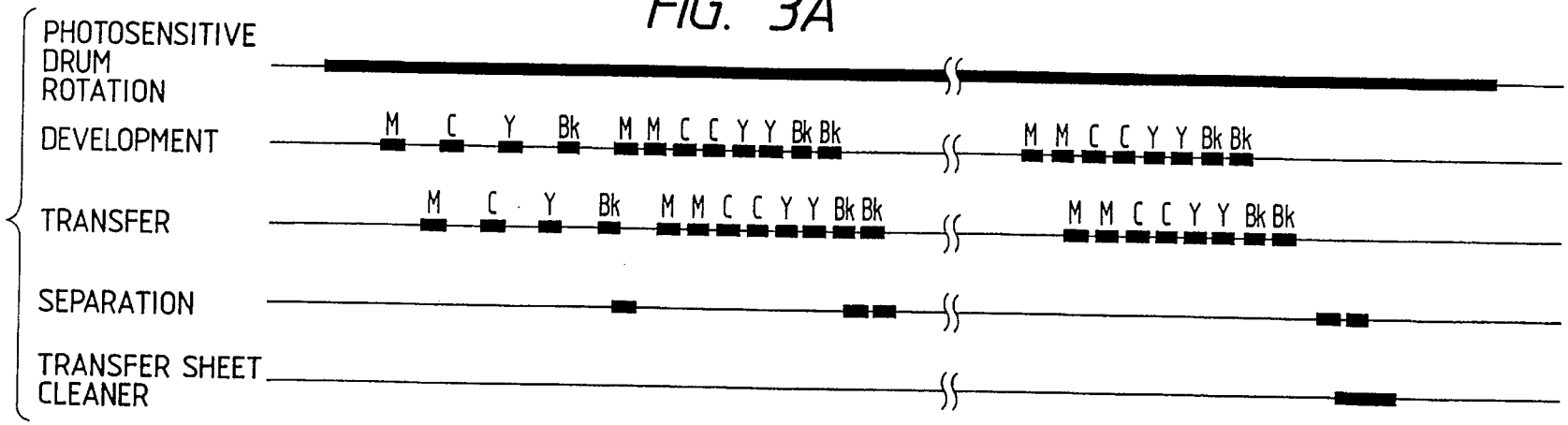
FIG. 3A is a sequence chart of the example 1 when the number of sheets for consecutive image formation is odd.
Figure 3B:
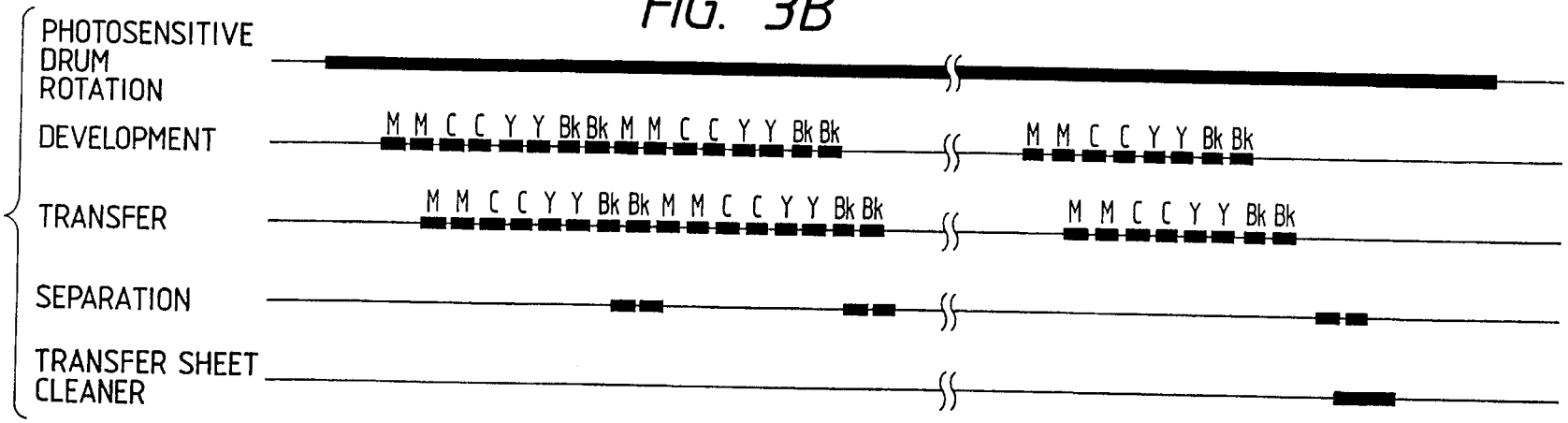
FIG. 3B is a sequence chart of the example 1 when the number of sheets for consecutive image formation is even.
Figure 3C:
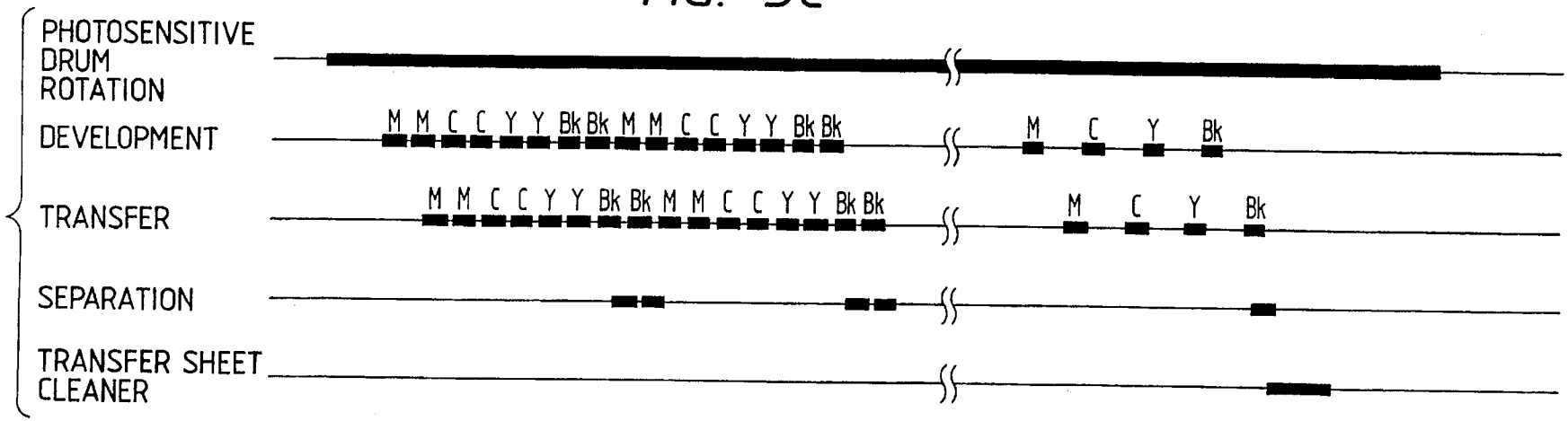
FIG. 3C is a sequence chart of a comparative example when the number of sheets for consecutive image formation is odd.

FIGS. 3A, 3B and 3C are sequence charts in this example, wherein this example will be described with an instance of bearing two transfer media concurrently on the transfer drum 105*a* in making the image formation on the second face of the transfer medium having formed the image on the first face. FIG. 3A, FIG. 3B and FIG. 3C show the image formation for the odd number of sheets in this example, for the even number of sheets in this example, and for the odd number of sheets in a comparison example, respectively.

In FIG. 3A, the image formation is first performed by bearing one transfer medium, the number of sheets equal to 1 corresponding to the remainder obtained by dividing the image forming sheet number by the maximum sheet bearing number of the transfer drum 105*a* which is equal to 2, and then, by bearing transfer media of the maximum sheet bearing number which is equal to 2. In this case, the transfer medium is not separated during the same rotation as the transfer operation of the final color, but again passed through the transfer unit and then separated, while the transfer cleaning device 126 is working during the same rotation. In this manner, to activate the transfer cleaning device 126 during the same rotation as the separation operation is a mandatory requirement to prevent the oil from transitting onto the photosensitive drum 101. Accordingly, in this case, the reason of avoiding the separating operation during the same rotation as the transfer operation of the final color is that the apparent paper length is lengthened because of bearing two transfer media, and when the leading end of the first sheet passes through the transfer cleaning unit, the transfer of the final color for the second sheet is being still performed, and therefore it is necessary to avoid any shock caused upon the transfer cleaning device 126 seating on the transfer drum 105*a* must be to prevent color aberration.

On the contrary, in FIG. 3B, because the number of image forming sheets is divisible by the maximum sheet bearing number, two transfer media can be borne on the transfer drum 105*a* from the first to the end to form the image. Also, in this case, neither separation operation nor transfer cleaning operation are performed during the same rotation as the transfer operation of the final color.

On the other hand, in FIG. 3C, even with the image formation for the odd number of sheets as in FIG. 3A, two transfer media are first borne, and finally one transfer medium is borne to form the image. The image forming sequence in FIG. 3C is effective because there is no risk that the transfer medium bearing sheet 105*f* is contaminated with the oil in making the image formation on only one surface or both surfaces, and the image forming speed is higher by the amount of final half rotation than that of FIG. 3A. However, in this case, to prevent color aberration due to the shock of the transfer cleaning device 126, it is required that the idle rotation is effected while the transfer medium is being borne, or the transfer and the separation are performed during the same rotation, as was conventionally seen, but the transfer sheet cleaning 126 is made during the subsequent rotation.

By using such an image forming sequence, it is possible to prevent the oil remaining on the side of the transfer medium bearing member having no transfer medium borne in the final image formation from transitting onto the image carrier, upon making the image formation on both faces in the method of image formation by bearing two sheets concurrently, and thereby prevent the fog in the white portion or the void in the solid portion on the transfer medium.

<EXAMPLE 2>

In the example 1, only one cleaning member of the web or roller type was utilized as the transfer cleaning device 126, but such cleaning member is unpreferable in view of the life of the transfer medium bearing sheet 105*f* because it strongly rubs on the transfer medium bearing sheet 105*f*. Also, such rubbing cleaning is necessary to effect oil removal, but only for the toner removal, a fur brush cleaner or the like may be sufficient by which the transfer medium bearing sheet 105*f* is cleaned relatively soft. Thus, the present invention is also effective to the case where the transfer cleaning device 126 comprises two cleaning devices including a fur brush cleaner for the toner and a rubbing cleaner for the oil removal.

Figure 4:
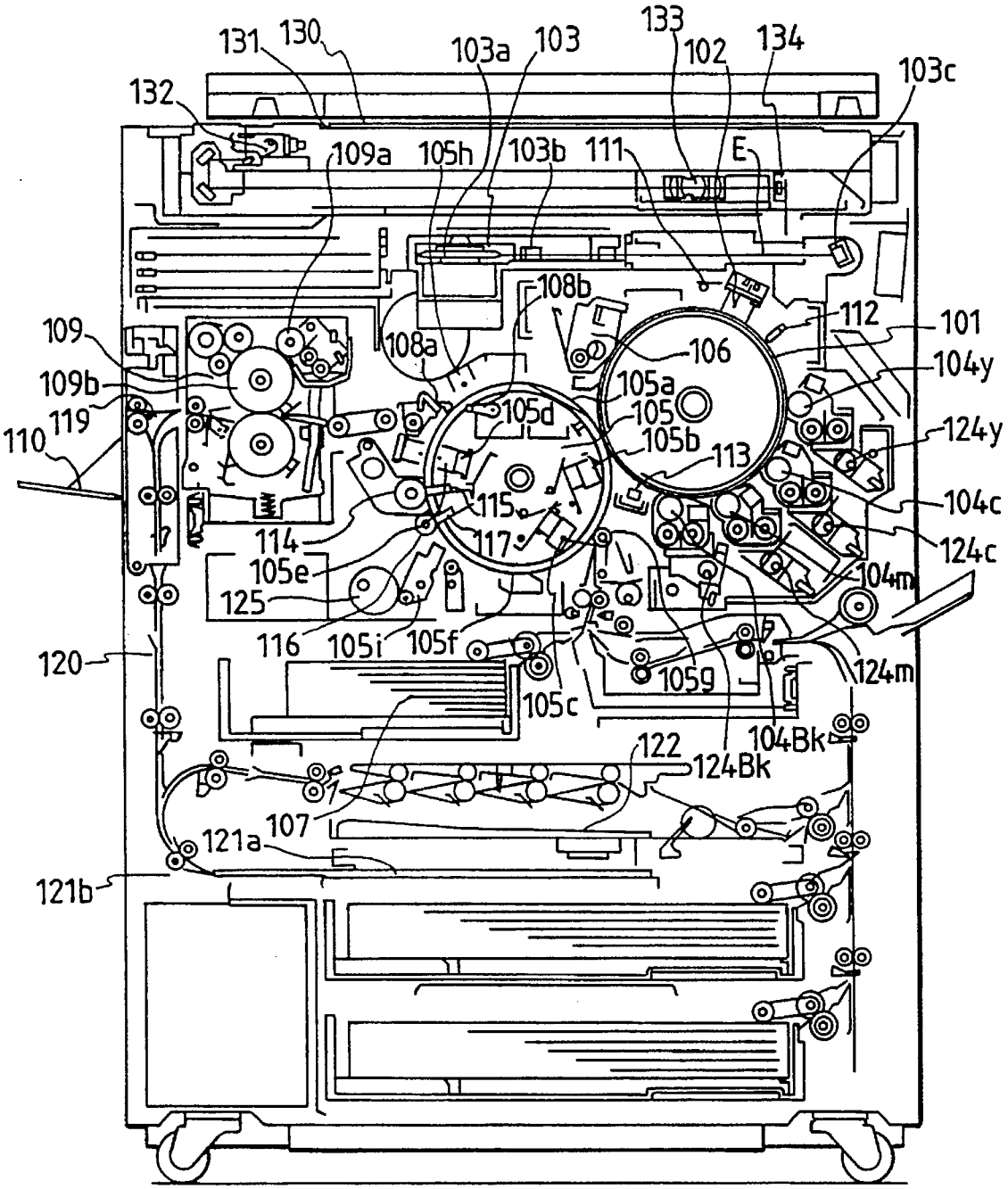
FIG. 4 is a longitudinal cross-sectional view showing a schematic construction of a color image forming apparatus in an example 2.

FIG. 4 illustrates such a full-color image forming apparatus, which comprises two cleaners consisting of a toner removal cleaner and an oil removal cleaner as the cleaner for the transfer medium bearing sheet 105*f*. Herein, the toner removal cleaner is provided with a fur brush 114 and a backup brush 115 opposite the fur brush 114 via the transfer medium bearing sheet 105*f*, while the oil removal cleaner is provided with an oil removal roller 116 and the transfer medium bearing sheet 105*f*. Also, the oil removal roller 116 may be a cleaner of the web type which was used in the example 1.

The cleaning of the transfer medium bearing sheet 105*f* by the above two cleaners is performed before and after forming the image, and optionally when a jam (paper feed failure) occurs.

The oil removal cleaner is preferably operated only when forming the image on both faces to rub the surface of the transfer medium bearing sheet 105*f*, and preferably employed together with the toner removal cleaner 9A for the toner to prevent the clogging due to the toner, depending on whether or not the leading end of the first transfer medium has passed through the cleaning part between the toner removal cleaner and the transfer medium bearing sheet 6*g* in this example.

The image operation sequence is identical to that of the example 1, and the description thereof is omitted, but the color aberration due to the shock in cleaning and the adverse effect on the image can be relieved by applying the present invention in the above manner.

<EXAMPLE 3>

Figure 7:
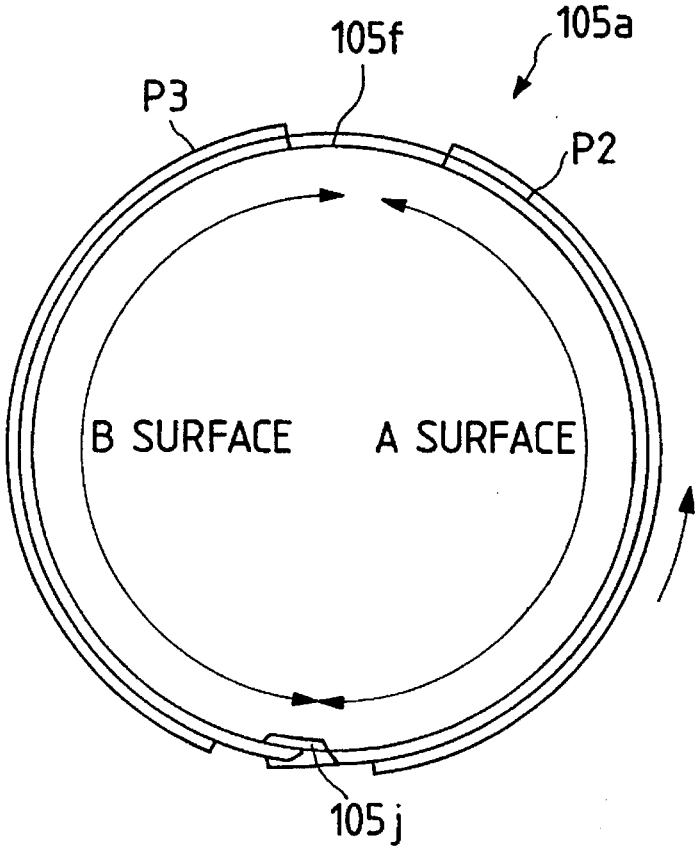
FIG. 7 is a cross-sectional view of a transfer drum capable of bearing two transfer media.

The copying operation of this example in the color image forming apparatus of the example 1 and 2 will be described below with reference to an image forming timing chart of FIG. 5. Note that the transfer medium bearing sheet 105*f* is held in a cylindrical form with the leading and trailing ends bonded to a bone 105*j* of the transfer drum 105*a*, as shown in FIG. 7, so that two transfer media P2 and P3 can be adsorbed electrostatically. Herein, the upstream side in the rotational direction is assumed A surface and the downstream side B surface, with the bone 105*j* as a starting point.

Figure 5:
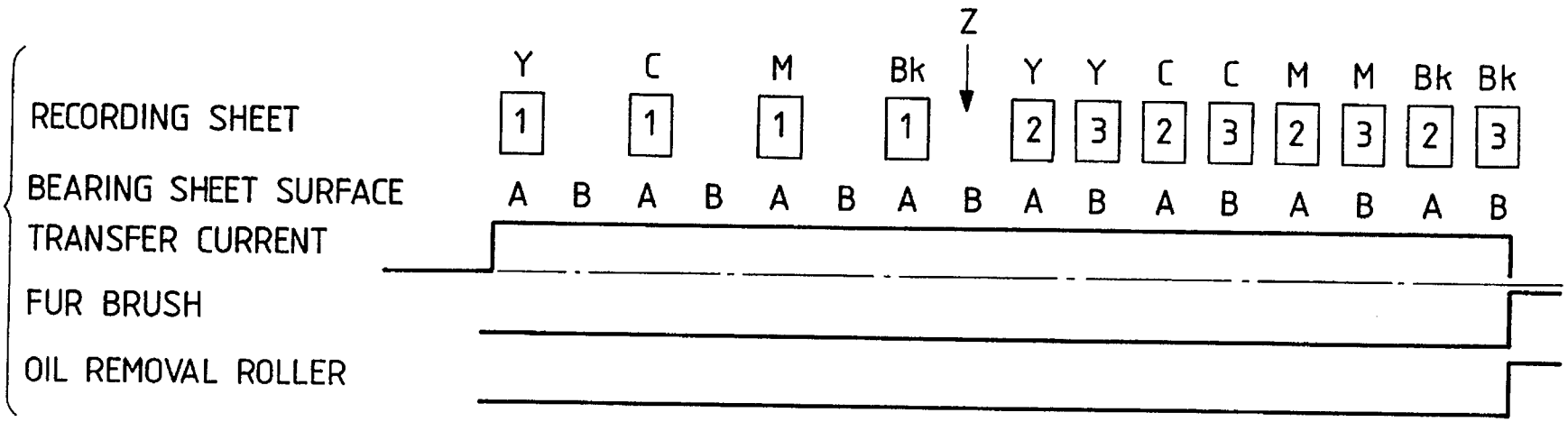
FIG. 5 is a timing chart in examples 3 and 4.
Figure 6:
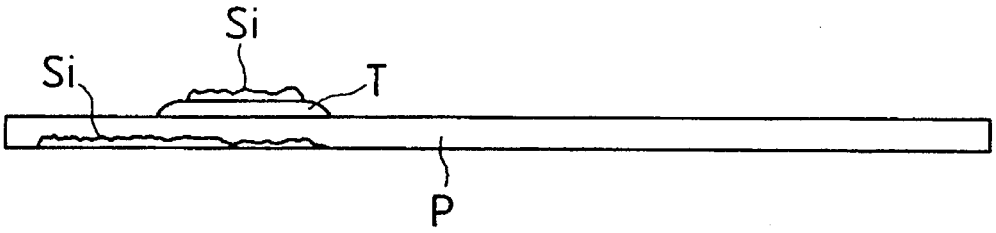
FIG. 6 is a cross-sectional view showing the state of the toner and silicone oil on the transfer medium after fixing.

As shown in the timing chart of FIG. 5, when the copying operation is desired on the second face for three transfer media having the image fixed on the first face, the transfer medium P1 which is one transfer medium is borne on the A surface of the transfer medium bearing sheet 105*f*, subjected to the transfer in yellow (Y), cyan (C), magenta (M) and black (Bk), and separated from the transfer medium bearing sheet 105*f*, and thereafter, two transfer media P2 and P3 are borne on the A surface and the B surface of the transfer medium bearing sheet 105*f*, respectively, and subjected to the transfer in yellow (Y), cyan (C), magenta (M) and black (Bk). Then, the fur brush and the oil removal roller are operated to remove the oil attached on the transfer medium bearing sheet, then preparing for the next process. In this way, the area of the transfer medium bearing sheet 105*f* which has once contacted with the first face of the transfer medium is by no means passed through the transfer unit without having transfer medium until the oil cleaning is performed in this example. Also, in this example, the transfer drum is rotated substantially eight times to complete the copying of three sheets. Accordingly, it is necessary to have an extra half rotation in comparison with an instance where the copying operation is performed by first causing two transfer media P1, P2 to be adsorbed onto the transfer drum 105*a* without regard to the oil deposit onto the photosensitive drum 101, but extra two seconds may be only taken for this half rotation in the color copying machine of 7.5 sheets/min.

As described above, by virtue of this example, for an image forming apparatus of the type such as a color copying machine in which a quantity of releasable oil is applied to the transfer medium, it is possible to prevent the oil transition onto the image carrier without specifically requiring no additional devices, and therefore prevent any damage on the image carrier, the cleaner and the developing unit. Also, the image formation can be carried out without substantial increase in the required time.

<EXAMPLE 4>

In the example 3, an extra half rotation is necessary in forming the image onto the odd number of transfer media, using the transfer drum 105 capable of bearing two transfer media, in comparison with an instance where the copying operation is performed without regard to oil deposit onto the photosensitive drum 101, so that about two seconds of image formation time in extra was necessary.

Thus, in this example, after black (Bk) is transferred onto the transfer medium P1 adsorbed onto the A surface of the transfer medium bearing sheet 105*f*, the transfer medium P2 is adsorbed at Z position as shown in FIG. 1, that is, on the B surface, and then the transfer medium P3 is adsorbed onto the A surface after the transfer medium P1 is separated. Thereby, the copying operation can be completed in the same time as when it is performed with two transfer media first adsorbed.

Note that if the contact between the photosensitive drum 101 and the transfer medium bearing sheet are released or the pressure on the transfer electrifier 105*b* is released, after black (Bk) is transferred onto the transfer medium P3, the operation of the oil removal roller 116 is unnecessary. However, where after copying two transfer media adsorbed on both the A and B surfaces, one medium is then copied (in a different mode), or where after copying a sheet of large size extending from the A surface to the B surface, the smaller size sheet is copied, it is necessary to clean the surface of the transfer medium bearing sheet at least in the area not used at the next copying. The cleaning may be permitted after the completion of copying, or before the start of copying, but can be omitted depending on the copy mode, before the start of copying. Also, when copied onto one transfer medium of the minimum size, the cleaning can be omitted. Other than when copied on both faces, it is also effective in using the transfer medium having the release agent preapplied on the surface, for example.

<EXAMPLE 5>

Figure 8:
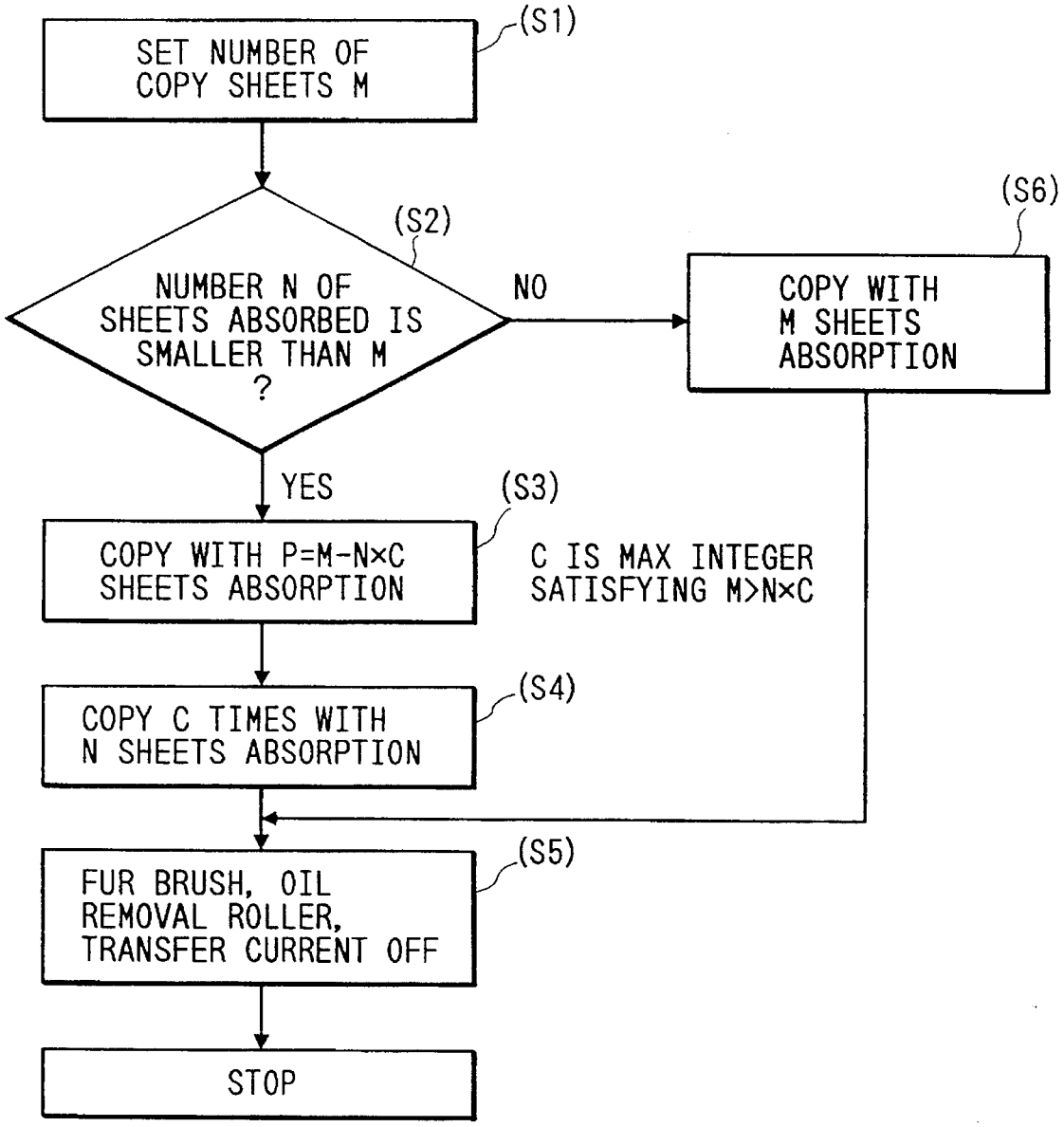
FIG. 8 is a flow chart of image formation in an example 5.

A fifth example of an image forming apparatus according to the present invention will be described below with an image forming flow chart of FIG. 8.

After the number of copy sheets M is set (step 1), a check is performed to determine whether M is greater than N (step 2), where the maximum number of sheets to be borne adsorbable on the transfer medium bearing sheet 105*f* is N. If M is greater than N, first supposing that the number of sheets adsorbed $P=M-N\times C$ (where C is the maximum integer satisfying $M>N\times C$), P sheets are adsorbed on the transfer medium bearing sheet 105*f*, and the copying operation is performed (step 3). For example, in an apparatus in which the copy number is five, and the number of sheets adsorbable is two, $5-2\times 2=1$, and one transfer medium is first adsorbed onto the transfer medium bearing sheet 105*f* to perform the copying operation.

Then, with N sheets adsorption, the copying operation is repeated C times (step 4). The fur brush 114 and the oil removal roller 116 are operated and the transfer current is turned off (step 5). Note that at step 2, if $M\leqq N$, the copying operation is performed with M sheets adsorption (step 6), the procedure passes to step 5.

Figure 9:
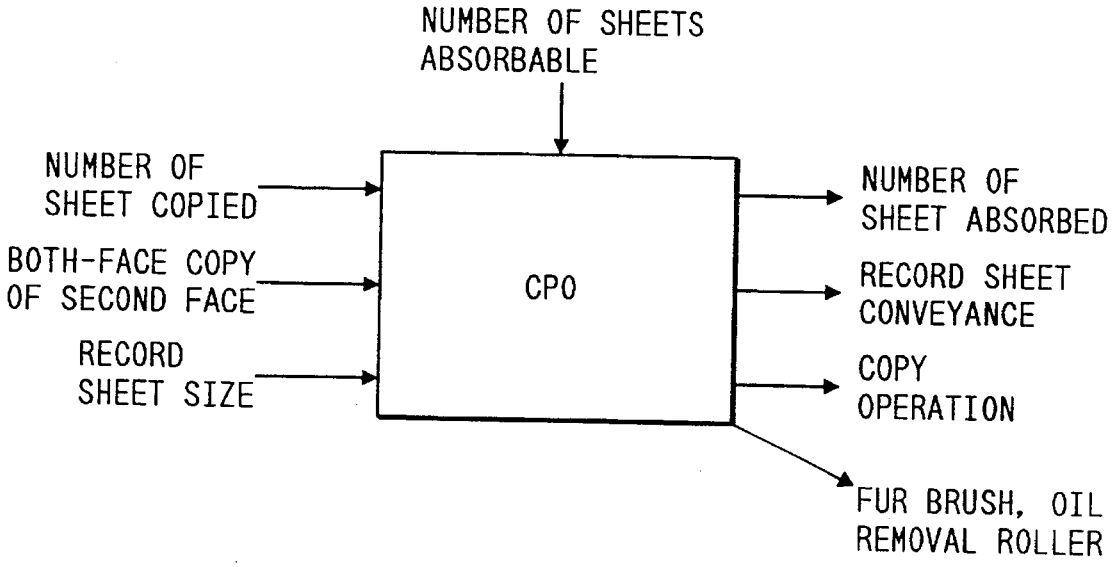
FIG. 9 is a block diagram of image formation in the example 5.
Figure 10:
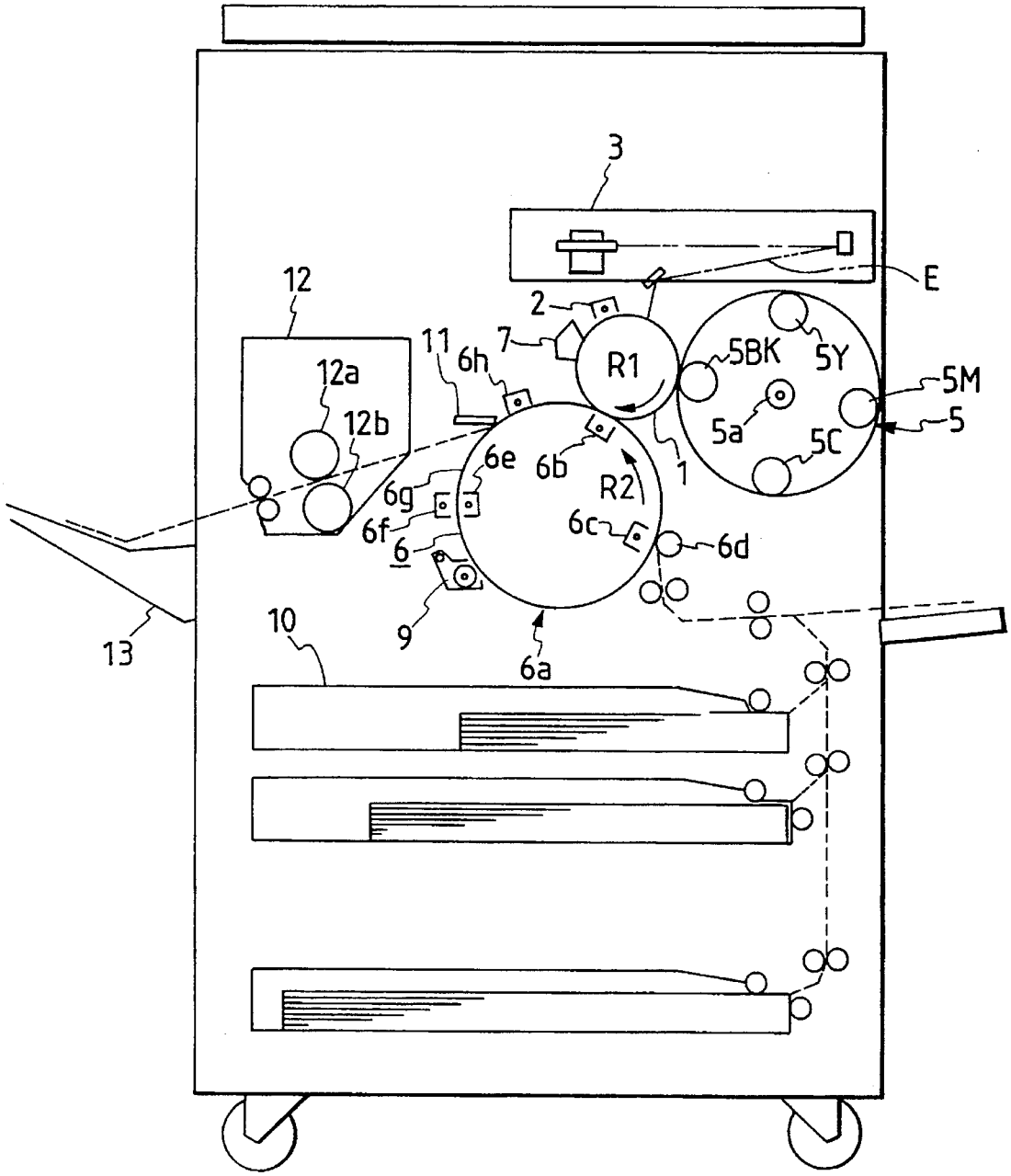
FIG. 10 is a longitudinal cross-sectional view showing a schematic construction of a conventional color image forming apparatus.

The above copying operation is executed by inputting information including the number of sheets copied, the both-face copy of second face, the recording sheet size, the number of sheets absorbable, into a central processing unit CPU, and setting various conditions such as the number of sheets absorbed, the record sheet conveyance, the copying operation, the fur brush, and the oil removal operation, as shown in a block diagram of FIG. 9.

<EXAMPLE 6>

While in the above examples, the effects of the present invention have been described with the case of concurrent two sheets bearing image formation system, the present invention is also effective in the case of concurrent three or more multiple sheets bearing image formation system. For example, where the size of transfer medium is as small as B5, and the peripheral length of transfer drum 6*a* is equal to three or more times the length of transfer medium, three transfer media can be borne on the transfer drum 6*a* concurrently to form an image. In this case, the number of sheets to be first borne on the transfer drum 105*a* is equal to the remainder obtained by dividing the number of sheets subjected to consecutive image formation by 3. For example, where the image formation for eight sheets is consecutively made, two sheets are first borne subsequently three sheets are borne, and then three sheets are borne.

Using such image formation sequence, it is possible to eliminate the adverse effect on the image due to oil transition, even when adopting the image formation method for bearing multiple sheets concurrently.

Also, in order to prevent oil transition to the photosensitive drum 101, it is required that the number of transfer media to be concurrently borne at the n-th time on the transfer drum 105*a* (n is a natural number equal to or greater than 2) is not less than the number of transfer media concurrently borne at the (n−1)-th time. That is, for example, when the image formation for seven transfer media is consecutively performed, using a transfer drum 105*a* capable of bearing three transfer media concurrently, the transfer drum 105*a* may bear one sheet at the first time, three sheets at the second time, and three sheets at the third time, or may bear two sheets at the first time, two sheets at the second time, and three sheets at the third time.

In this manner, by supplying the transfer medium each time to the area of the transfer drum 105*a* which has once borne the transfer medium during the consecutive image transfer, until the image transfer onto all the transfer media is completed, the oil transition to the photosensitive drum 101 can be prevented.

<EXAMPLE 7>

In the example 3, concurrent three sheets bearing image formation was performed, because the peripheral length of the transfer drum 105*a* is simply three or more times the length of the transfer medium. Of course, higher speed through-put is desirable for the user, but when the transfer medium is a small but thick paper such as a postcard, it is often necessary to select an appropriate concurrent two sheets bearing image formation system from the respect of having the secure fixing ability. Such selection of the maximum number of sheets to be borne on the transfer drum 105*a* may be switched by the user, or through the automatic detection.

For example, when the image formation for nine sheets is consecutively made on the postcard, not only three sheets—three sheets—three sheets, but also one sheet—two sheets—two sheets—two sheets—two sheets, may be allowed. However, even if the size or thickness of the transfer medium, or the material are changed, the effects of the present invention can be also exhibited only by appropriately changing the number of sheets.

<EXAMPLE 8>

An example 8 which uses a color image forming apparatus of the example 1 or 2 will be described below.

FIGS. 11A to 11D show the transition of fixing oil when the image formation is made on both faces of three transfer media, using a transfer drum 105*a* capable of bearing two transfer media.

Figure 11A:
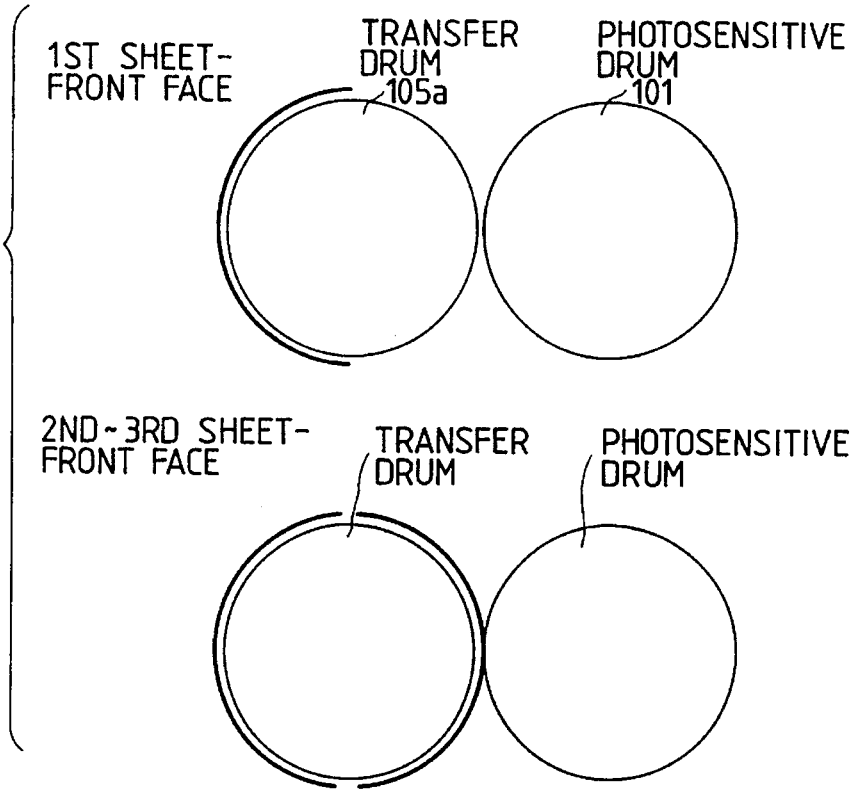
FIGS. 11A to 11D are cross-sectional views showing how the fixing oil is transitted.
Figure 11B:
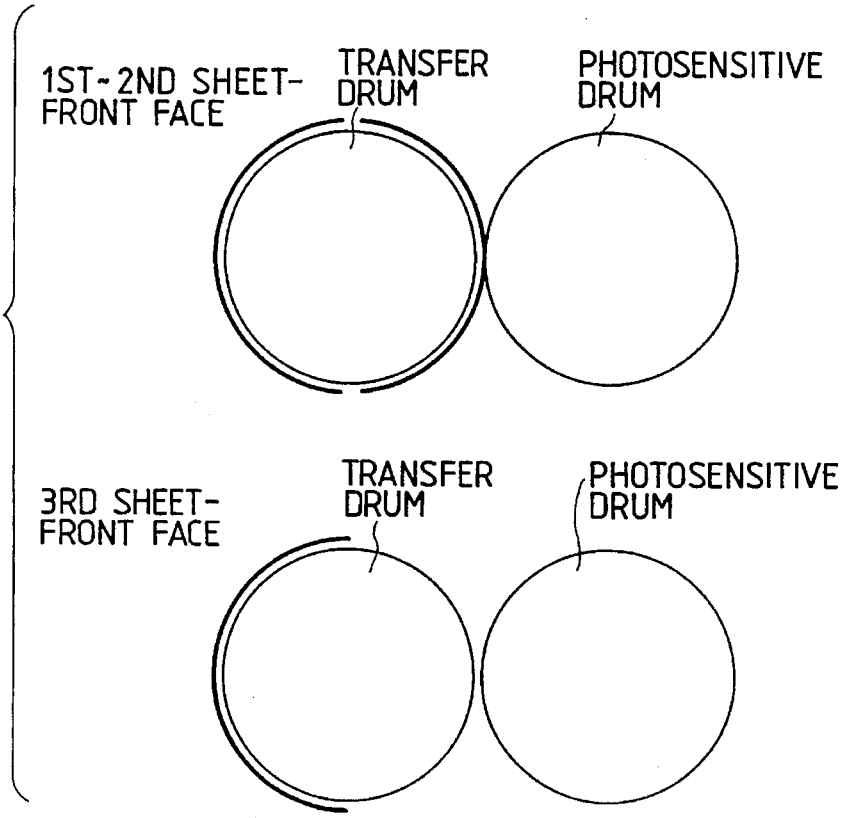

FIG. 11A shows an instance where in transferring the image of the photosensitive drum 101 on the surface of the transfer medium, one transfer medium is borne at the first time and two transfer media are borne at the second time, and FIG. 11*b* shows an instance where two transfer media are borne at the first time and one transfer medium is borne at the second time.

Figure 11C:
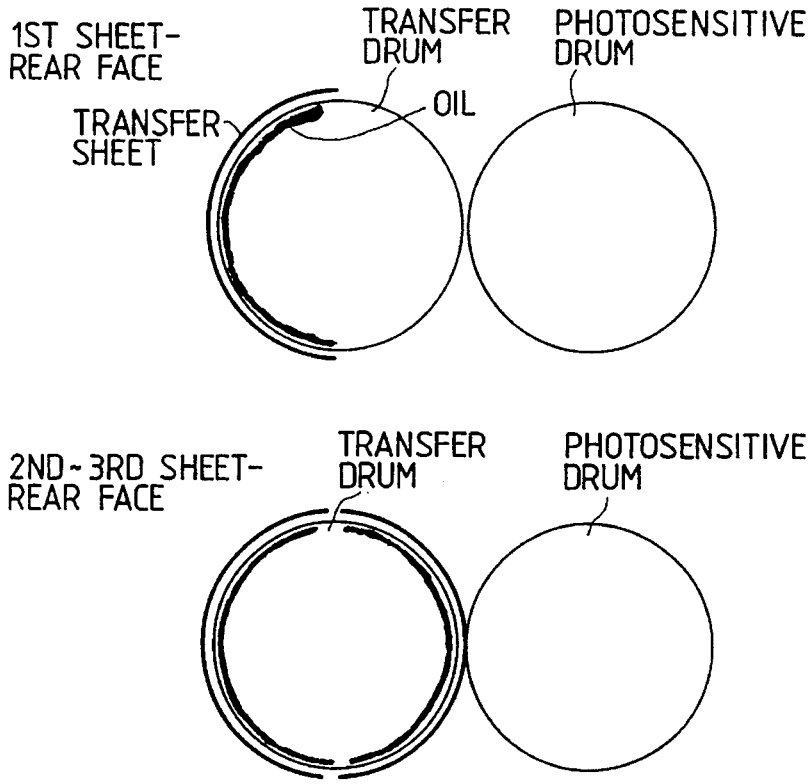

FIG. 11C shows an instance where in transferring the image of the photosensitive drum 101 onto the back surface of the transfer medium, one transfer medium is borne at the first time and two transfer media are borne at the second time.

Figure 11D:
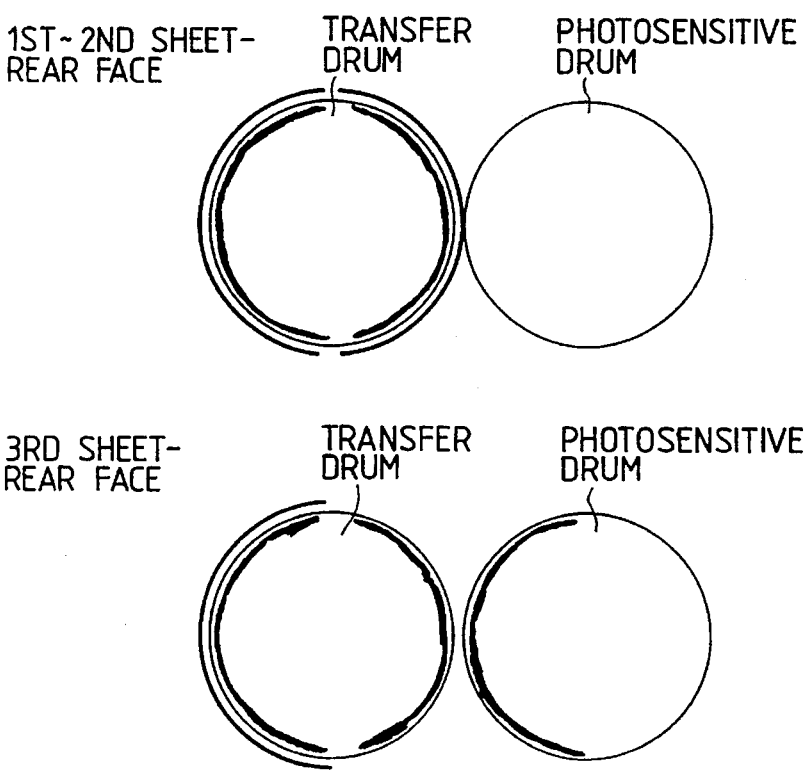

Also, FIG. 11D shows a comparative example where in transferring the image of the photosensitive drum 101 onto the back surface of the transfer medium, two transfer media are borne at the first time and one transfer medium is borne at the second time.

As shown in each figure, by forming the image on both faces of the transfer medium in such a way that the image formation on the surface of the transfer medium are performed in accordance with FIG. 11A or 11B, and subsequently, the image formation on the back surface of the transfer medium is performed in accordance with FIG. 11C, it is possible to prevent the transition of fixing oil onto the photosensitive drum 101.

However, considering the image forming time length, if one transfer medium having the image formed on the surface is borne in the area of the transfer drum 105*a* having no transfer medium borne, after the image transfer onto the third transfer medium as shown in FIG. 11B is terminated, and the image formation on the back surface is performed as shown in FIG. 11C, the image forming time length can be shortened by the amount of one-half rotation, as compared with a sequence of forming the image of the surface as shown in FIG. 11A and the back surface as shown in FIG. 11C.

What is claimed is:

1. An image forming apparatus comprising:

an image carrier for carrying an image thereon;

a transfer material bearing member for bearing and conveying a transfer material to a transfer position on said image carrier, said transfer material bearing member being capable of bearing multiple transfer materials concurrently; and transfer means for transferring the image on said image carrier onto one or more transfer materials borne on said transfer material bearing member at said transfer position;

wherein in consecutively transferring the image onto a number of transfer materials, in a case where the number of transfer materials is not divisible by a maximum number of transfer materials that said transfer material bearing member is capable of bearing concurrently, a number of transfer materials borne on said transfer material bearing member concurrently at an n-th time, where n is a natural number equal to or greater than two, is not less than a number of transfer materials borne concurrently at an (n−1)-th time; and wherein in transferring the image consecutively, a number of transfer materials that said transfer material bearing member concurrently bears at a final time is greater than a number of transfer materials that said transfer material bearing member concurrently bears at a first time.

2. An image forming apparatus according to claim 1, wherein a transfer material is borne every time in an area of said transfer material bearing member which bore a transfer material during consecutive image transfer, until image transfer onto all transfer materials has been completed.

3. An image forming apparatus according to claim 1, wherein said transfer material, before being borne on said transfer material bearing member, has the image formed on a surface thereof in contact with said transfer material bearing member.

4. An image forming apparatus according to claim 1, wherein said image forming apparatus forms the image on first surfaces of a plurality of transfer materials consecutively, then bears the plurality of transfer materials such that the first surfaces are in contact with said transfer material bearing member, and transfers the image on said image carrier onto second surfaces of the plurality of transfer materials.

5. An image forming apparatus according to claim 4, further comprising fixing means for fixing the image on a transfer material, said fixing means having a pair of rotational bodies which contact an unfixed image formed on the transfer material, wherein a release agent is applied to a rotational body which is to contact a side of the transfer material having the unfixed.

6. An image forming apparatus according to claim 5, wherein said release agent is oil.

7. An image forming apparatus according to claim 5, further comprising cleaning means for cleaning a transfer material bearing surface of said transfer material bearing member, wherein in consecutively transferring the image on said image carrier onto the plurality of transfer materials, said cleaning means cleans said transfer material bearing member after image transfer onto all transfer materials has been completed.

8. An image forming apparatus according to claim 7, wherein said cleaning means comprises a release agent removal cleaner for removing a release agent applied to said transfer material bearing member, said release agent removal cleaner cleaning said transfer material bearing member after the image on said image carrier has been transferred consecutively onto the second surface of the plurality of transfer materials.

9. An image forming apparatus according to claim 7 or 8, wherein during consecutive image transfer, an area of said transfer material bearing member which bore the transfer material is not passed through said transfer position without bearing a transfer material until said area of said transfer material bearing member is cleaned by said cleaning means.

10. An image forming apparatus according to claim 4, wherein in transferring the image on said image carrier onto the first surfaces of the plurality of transfer materials consecutively, the number of transfer materials borne on said transfer material bearing member concurrently at the n-th time is not more than the number of transfer materials borne concurrently at the (n−1)-th time, and wherein the number of transfer materials borne on said transfer material bearing member concurrently at the final time during consecutive image transfer is less than the number of transfer materials borne on said transfer material bearing member concurrently at the first time.

11. An image forming apparatus according to claim 10, wherein in transferring the image on said image carrier consecutively on the second surfaces of the plurality of transfer materials having the image formed on their respective first surfaces, a transfer material having the image formed on a first surface thereof is borne on an area of said transfer material bearing member in which no transfer material was borne at a final time during consecutive image transfer in order to perform image transfer onto a second surface of said transfer material.

12. An image forming apparatus according to claim 1, wherein said transfer material bearing member conveys the transfer material to said transfer position multiple times, so that the image on said image carrier is transferred in succession and superimposed onto the transfer material.

13. An image forming apparatus according to claim 12, wherein said image carrier carries plural images having plural colors in succession, and said plural images are transferred in succession and superimposed onto the transfer material.

14. An image forming apparatus comprising:

an image carrier for carrying an image thereon;

a transfer material bearing member for bearing and conveying a transfer material to a transfer position on said image carrier, said transfer material bearing member being capable of bearing multiple transfer materials concurrently; and transfer means for transferring the image on said image carrier onto one or more transfer materials borne on said transfer material bearing member at said transfer position;

wherein in consecutively transferring the image onto M transfer materials, in which a number M is not divisible by a maximum number N of transfer materials that the transfer material bearing member is capable of bearing concurrently, said transfer material bearing member concurrently bears, at a first time, P transfer materials, where P is a number which is greater than or equal to 1 and which corresponds to a remainder obtained when M is divided by N, and wherein at other times, said transfer material bearing member bears N transfer materials.

15. An image forming apparatus according to claim 14, wherein the M transfer materials have the image formed on surfaces thereof which are in contact with said transfer material bearing member before the M transfer materials are borne on said transfer material bearing member.

16. An image forming apparatus according to claim 14, wherein said image forming apparatus forms the image on first surfaces of the M transfer materials consecutively, then bears the M transfer materials such that their first surfaces are in contact with a said transfer material bearing member, and transfers the image on said image carrier onto second surfaces of the M transfer materials.

17. An image forming apparatus according to claim 16, further comprising fixing means for fixing the image on a transfer material, said fixing means having a pair of rotational bodies which contact an unfixed image on the transfer material, wherein a release agent is applied to a rotational body which will contact a side of the transfer material having the unfixed image.

18. An image forming apparatus according to claim 17, wherein said release agent is oil.

19. An image forming apparatus according to claim 17, further comprising cleaning means for cleaning a transfer material bearing surface of said transfer material bearing member, said cleaning means cleaning said transfer material bearing surface after image transfer onto the M transfer materials has been completed.

20. An image forming apparatus according to claim 19, wherein said cleaning means comprises a release agent removal cleaner for removing a release agent applied to said transfer material bearing member, said release agent removal cleaner cleaning said transfer material bearing member after image transfer onto the second surfaces of the M transfer materials has been completed.

21. An image forming apparatus according to claim 19 or 20, wherein during consecutive image transfer, an area of said transfer material bearing member which bore a transfer material is not passed through said transfer position without bearing a transfer material until said area of said transfer material bearing member has been cleaned by said cleaning means.

22. An image forming apparatus according to claim 16, wherein in consecutively transferring the image on said image carrier onto the first surfaces of the M transfer materials, said transfer material bearing member concurrently bears the P transfer materials at the final time.

23. An image forming apparatus according to claim 22, wherein the P transfer materials having the image formed on first surfaces thereof are borne on an area of the transfer material bearing member in which no transfer material was borne at a final time during consecutive image transfer onto the first surfaces of the transfer materials to perform image transfer onto the second surfaces of the transfer materials.

24. An image forming apparatus according to claim 14, wherein said transfer material bearing member coveys the transfer material to said transfer position multiple times, so that the image on said image carrier is transferred in succession and superimposed onto the transfer material.

25. An image forming apparatus according to claim 24, wherein said image carrier carries plural images having plural colors in succession, and said plural images are transferred in succession and superimposed onto the transfer material.

26. An image forming apparatus comprising:

an image carrier for carrying an image thereon;

a transfer material bearing member for bearing and conveying a transfer material to a transfer position on said image carrier, the transfer material bearing member being capable of bearing multiple transfer materials concurrently; and transfer means for transferring the image on said image carrier onto one or more transfer materials borne on said transfer material bearing member at said transfer position;

wherein in consecutively transferring the image onto a number of transfer materials in which the number is not divisible by a maximum number of transfer materials that the transfer material bearing member is capable of bearing concurrently, a number of transfer materials borne on said transfer material bearing member concurrently at a final time is greater than a number of transfer material borne on said transfer material bearing member concurrently at a first time; and wherein a transfer material is borne every time in an area of said transfer material bearing member which bore a transfer material during consecutive image transfer until image transfer onto all transfer materials has been completed.

27. An image forming apparatus according to claim 26, wherein the transfer material, before being borne on said transfer material bearing member, has the image formed on a surface thereof which contacts said transfer material bearing member.

28. An image forming apparatus according to claim 26, wherein said image forming apparatus forms the image on first surfaces of a plurality of transfer materials consecutively, then bears the plurality of transfer materials such that their first surfaces are in contact with said transfer material bearing member, and transfers the image on said image carrier onto second surfaces of the plurality of transfer materials.

29. An image forming apparatus according to claim 26, further comprising fixing means for fixing the image on the plurality of transfer materials, said fixing means having a pair of rotational bodies which contact an unfixed image formed on the transfer material, wherein a release agent is applied to a rotational body to be contacted with a side of the transfer material having the unfixed image.

30. An image forming apparatus according to claim 29, wherein said release agent is an oil.

31. An image forming apparatus according to claim 30, further comprising cleaning means for cleaning a transfer material bearing surface of said transfer material bearing member, wherein in consecutively transferring the image on said image carrier onto a plurality of transfer materials, said cleaning means cleans said transfer material bearing member after image transfer onto all transfer materials has been completed.

32. An image forming apparatus according to claim 31, wherein said cleaning means comprises a release agent removal cleaner for removing a release agent applied to said transfer material bearing member, said release agent removal cleaner cleaning said transfer material bearing member after the image on said image carrier has been transferred consecutively onto the second surfaces of the plurality of transfer materials.

33. An image forming apparatus according to claim 31 or 32, wherein during consecutive image transfer, an area of said transfer material bearing member which bore a transfer material is not passed through said transfer position without bearing a transfer material until said area of said transfer material bearing member is cleaned by said cleaning means.

34. An image forming apparatus according to claim 28, wherein in transferring the image on said image carrier onto the first surface of the plurality of transfer material consecutively, a number of transfer materials borne on said transfer material bearing member concurrently at the final time is less than a number of transfer materials borne on said transfer material bearing member concurrently at the first time.

35. An image forming apparatus according to claim 34, wherein in transferring the image on said image carrier consecutively on the second surfaces of the plurality of transfer materials, which have the image formed on first surfaces thereof, a transfer material having the image formed on a first surface thereof is borne on an area of said transfer material bearing member in which no transfer material was borne at the final time.

36. An image forming apparatus according to claim 26, wherein said transfer material bearing member conveys the transfer material to said transfer position multiple times so that the image on said image carrier is transferred in succession and superimposed onto the transfer material.

37. An image forming apparatus according to claim 36, wherein said image carrier carries plural images having plural colors in succession, and said plural images having plural colors are transferred in succession and superimposed onto the transfer material.

* * * * *

UNITED STATES PATENT AND TRADEMARK OFFICE

CERTIFICATE OF CORRECTION

PATENT NO. : 5,589,920

DATED : December 31, 1996

INVENTORS : Kubo et al.

It is certified that error appears in the above-identified patent and that said Letters Patent is hereby corrected as shown below:

On the title page: Item

[56] References Cited: "Rdenberg" should read --Rodenberg--.

COLUMN 3:

Line 36, "drum i" should read --drum 1--; and
Line 41, "1" should be deleted.

COLUMN 8:

Line 26, "soft." should read --softly.--; and
Line 27, "to" should read --in--.

COLUMN 9:

Line 53, "in" should be deleted.

COLUMN 12:

Line 24, "image of" should read --image on--.

COLUMN 13:

Line 13, "unfixed." should read --unfixed image.--.

UNITED STATES PATENT AND TRADEMARK OFFICE

CERTIFICATE OF CORRECTION

PATENT NO. : 5,589,920

DATED : December 31, 1996

INVENTORS : Kubo et al.

It is certified that error appears in the above-identified patent and that said Letters Patent is hereby corrected as shown below:

COLUMN 14:

Line 34, "a" should be deleted.

COLUMN 15:

Line 12, "coveys" should read --conveys--.

COLUMN 16:

Line 1, "26," should read --28,--.

Signed and Sealed this

Seventeenth Day of June, 1997

Bruce Lehman

*Attest:*

BRUCE LEHMAN

*Attesting Officer*

*Commissioner of Patents and Trademarks*